United States Patent [19]

Frigon

[11] Patent Number: 4,632,013

[45] Date of Patent: Dec. 30, 1986

[54] RECIPROCATING PISTON FLUID POWERED MOTOR

[75] Inventor: Richard Frigon, Michigan City, Ind.; Alan K. Forsythe, Tukurla, Wash.

[73] Assignee: Sprague Devices, Inc., Michigan City, Ind.

[21] Appl. No.: 623,080

[22] Filed: Jun. 21, 1984

[51] Int. Cl.[4] ..... F01L 25/04

[52] U.S. Cl. ..... 91/7; 91/291; 91/316; 91/319; 91/322

[58] Field of Search ..... 91/7, 291, 293, 294, 91/219, 290, 316, 319, 322

[56] References Cited

U.S. PATENT DOCUMENTS

| | | | |
|---|---|---|---|
| 643,732 | 2/1900 | Rhodes | 91/29 X |
| 785,172 | 3/1905 | Kasai | 91/293 |
| 1,577,914 | 3/1926 | Le Cain | 91/291 |
| 2,404,747 | 7/1946 | Sacchini | 91/7 |
| 2,487,113 | 11/1949 | Doyle | 91/7 |
| 3,165,978 | 1/1965 | Ruden et al. | 91/291 |

*Primary Examiner*—Robert E. Garrett
*Assistant Examiner*—Mark A. Williamson
*Attorney, Agent, or Firm*—James D. Hall

[57] ABSTRACT

A reciprocating piston fluid powered motor having fluid inlet and outlet, wherein reciprocation is controlled by a reciprocable valve spool carrying a manifold communicating with said fluid inlet and outlet and cooperating with a valve slide shiftable on said valve spool to control reciprocation of said valve spool.

7 Claims, 14 Drawing Figures

10
75
116
118
4.
112
114
110
5.
123
34
38
102
108
104
30
12
5.
43
22
96
98
86
94
66
72
74
68
61
56
50
60
62
26
70
63
62
63
61
54
16
64
4.
48
64
14

10
104
108
98
39
80
78
76
120
121
41
7.
7.
82
75
122
124
121
22
130
128
84
46
90
86
88
88
90
66
12
94
96
92
28
26
28
70
20
18
20
18

RECIPROCATING PISTON FLUID POWERED MOTOR

BACKGROUND OF THE INVENTION

This invention relates to a reciprocating piston fluid powered motor.

Heretofore, motors of this type have included a large cylindrical bore with a piston reciprocable therein responsive to directed air flow. Air flow has been directed by a valve which includes a spool having circumferential O-rings which fit in the bore of a valve housing. Shifting of the spool valve in response to the position of the piston in one direction causes redirection of pressurized inlet air to a port which causes shifting of the piston in the opposite direction. Exhausting of the motors of this type occurs at a port open to atmosphere.

Oftentimes, contamination, resulting from hydrocarbons in the pressure line from a vehicle engine to the fluid powered motor, will fill the clearance gap around the valve spool between the O-rings within the motor valve housing and prevent movement of the valve spool. Also, the O-rings tend to wear, swell, and stick as a result of the contamination which may include a varnish-like substance which results from engine hydrocarbons. The clearance gap also permits leakage of the varnish substance into the motor valve to cause sticking of the valve spool and inoperability of the motor.

SUMMARY OF THE INVENTION

The fluid powered motor of this invention eliminates the use of a valve spool with O-rings which form chambers for directing air into motor valve ports. The motor of this invention also includes a device for regulating the exhaust pressure.

Accordingly, it is an object of this invention to provide an improved reciprocating piston fluid powered motor.

Another object is to provide a reciprocating piston fluid powered motor which is reliable in its start-up and high speed operations.

Another object is to provide a motor which reduces or eliminates particle contamination.

Another object is to provide a motor which avoids leakage of contaminant materials into the fluid ports and valve of the motor.

Another object is to provide a motor which operates under high pressures at low speed which, as a result, provides better low-end control of the motor.

Other objects of this invention will become apparent upon a reading of the following description.

DESCRIPTION OF THE PREFERRED EMBODIMENT

Figure 1:
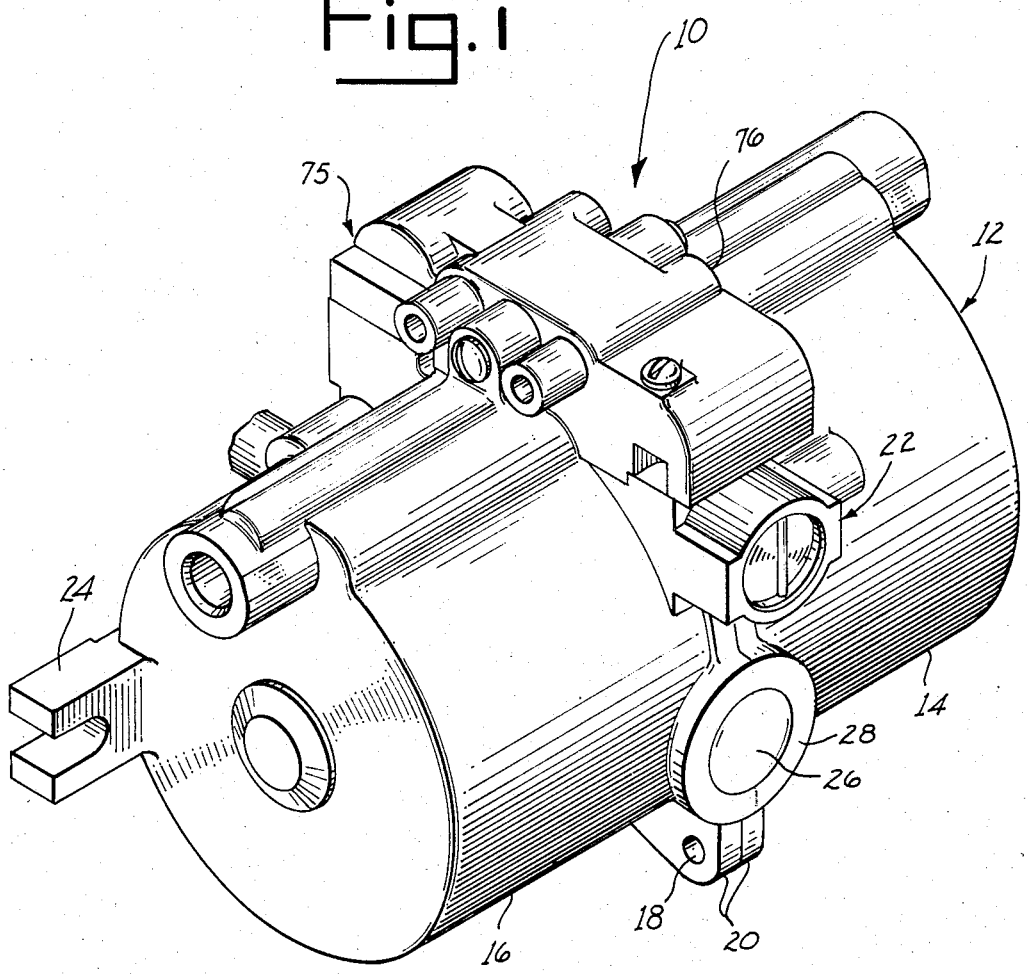
FIG. 1 is a perspective view of the motor.
Figure 2:
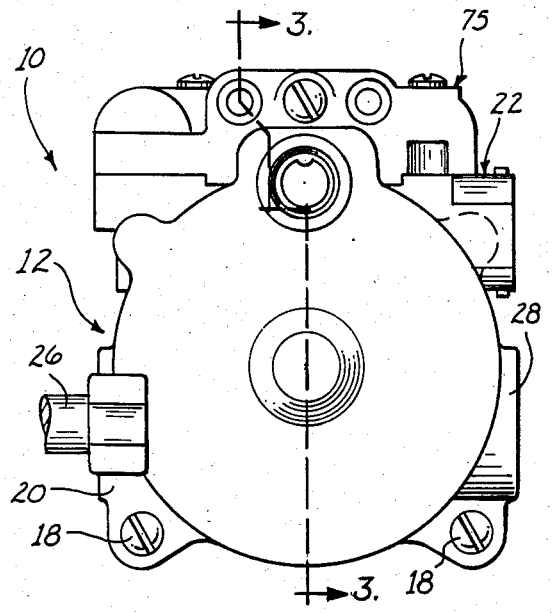
FIG. 2 is an end view of the motor.

The preferred embodiment illustrated is not intended to be exhaustive or to limit the invention to the precise form disclosed. It is chosen and described to explain the principles of the invention and its application and practical use to thereby enable others skilled in the art to utilize the invention.

Fluid power motor includes a housing 10 which has two complementary cup-shaped housing parts 14 and 16 secured together at their open ends, as by screws 18 extending through laterally projecting end flanges 20 to provide communicating piston bores 48 and 54. A valve housing 22 is secured to motor housing 10 between flanges 20. Motor housing 10 includes a mounting bracket 24 at each end. A motor shaft 26 is journaled in the housing between flanges 20, as by bearings 28. A manifold 75 is provided on valve housing 22.

Figure 4:
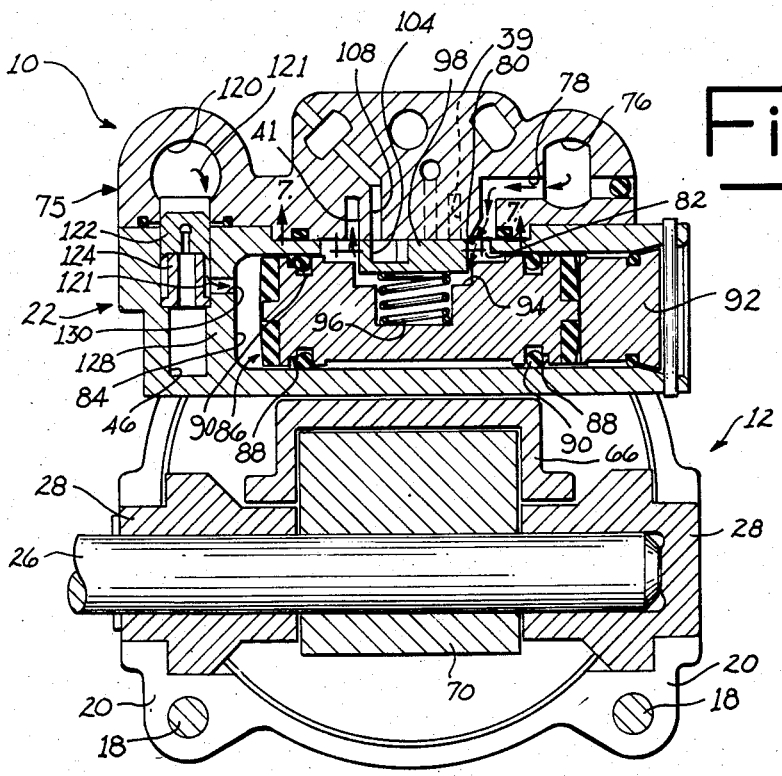
FIG. 4 is a sectional view taken along line 4—4 of FIG. 3.
Figure 5:
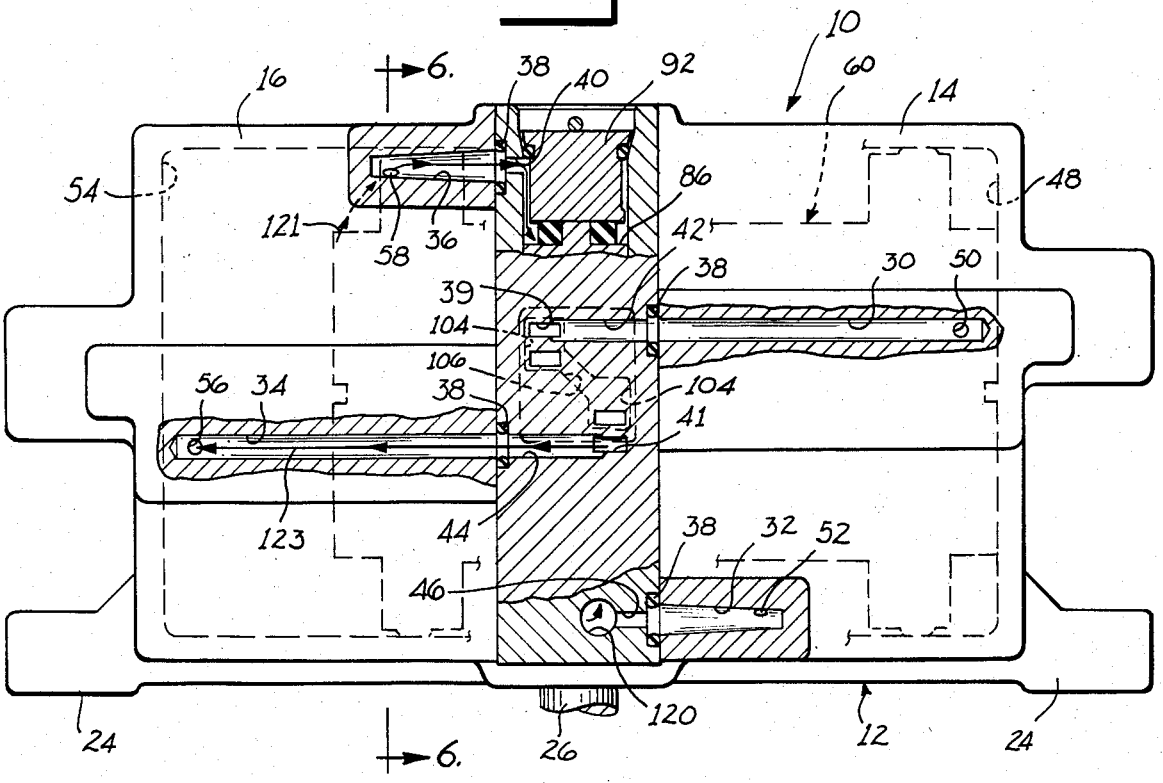
FIG. 5 is a sectional view taken along line 5—5 of FIG. 3 with portions broken away for purposes of illustration.
Figure 6:
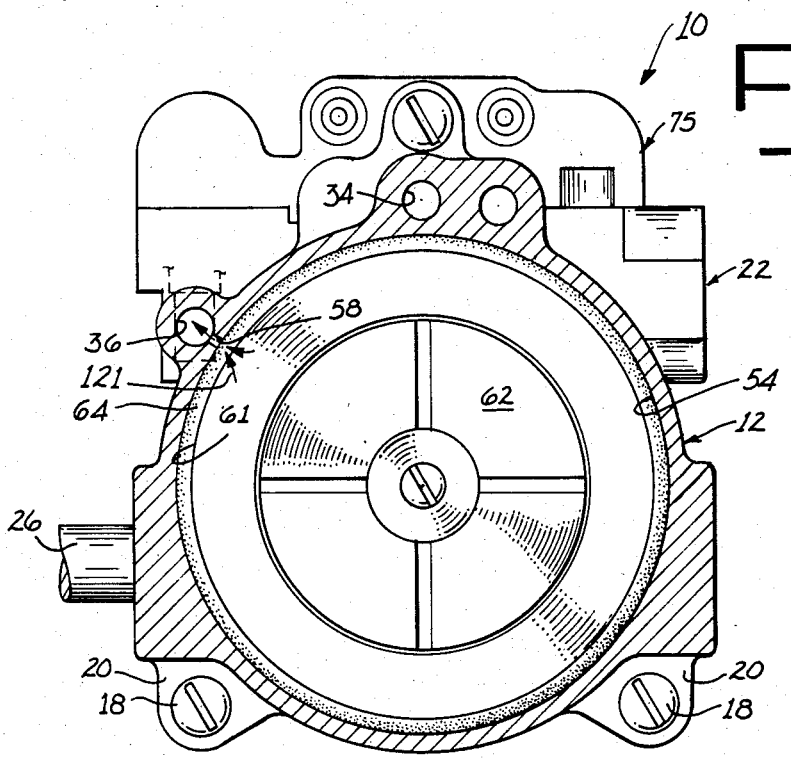
FIG. 6 is a sectional view taken along line 6—6 of FIG. 5.
Figure 8:
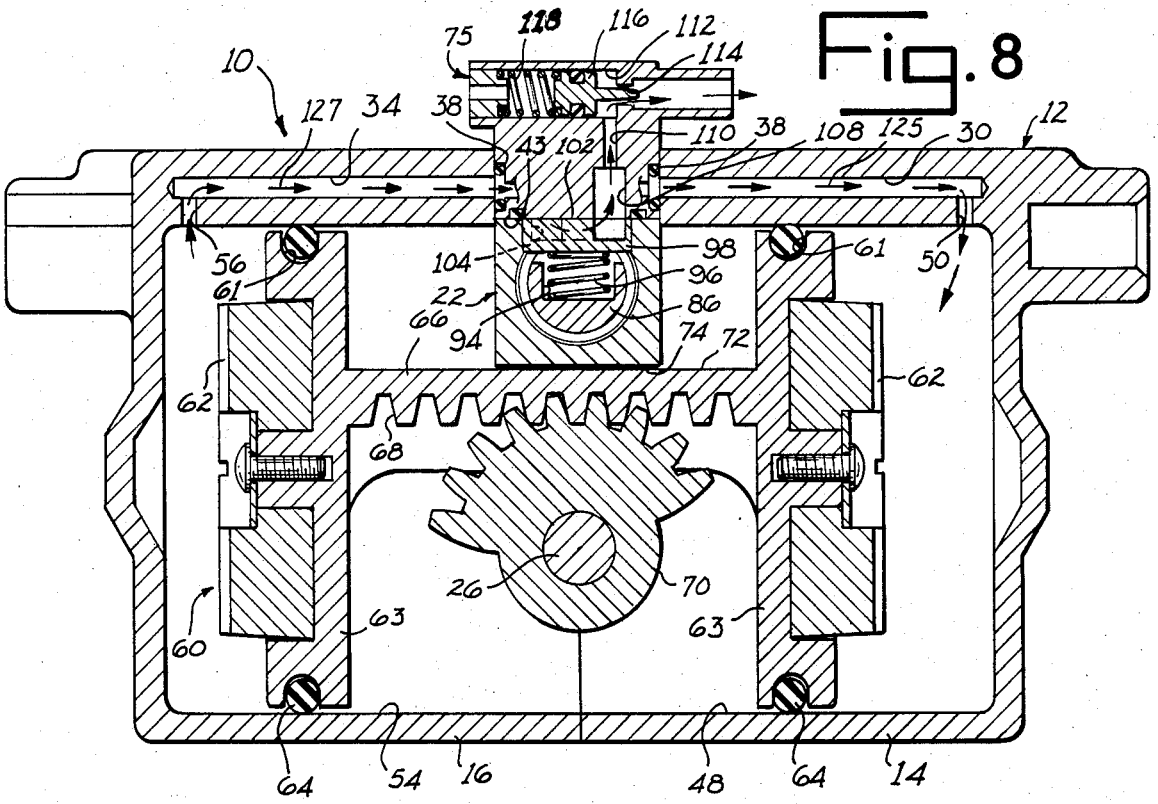
FIG. 8 is a sectional view taken on line 3—3 of FIG. 2 showing air flow and an operational position of the parts opposite this position shown in FIG. 3.
Figure 9:
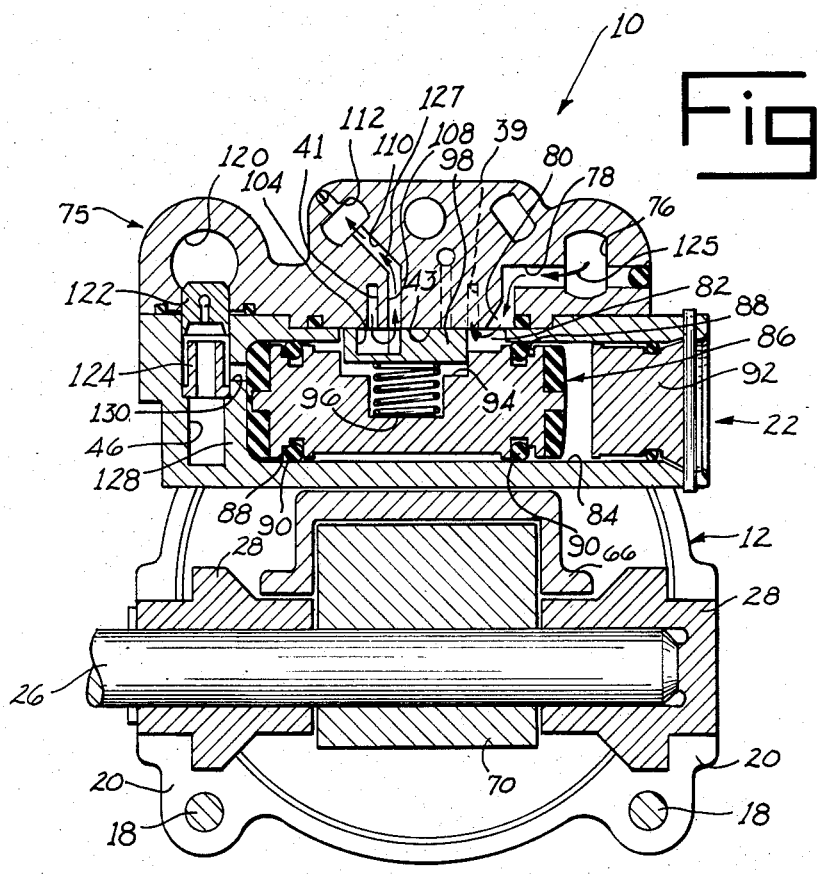
FIG. 9 is a sectional view taken on line 4—4 of FIG. 3 and shows the parts in the operational position of FIG. 8.

As seen in FIG. 5, the housing part 14 has formed therein internal passages 30, 32, and housing part 16 has formed therein passages 34 and 36. Seals are provided at 38 between bores 42 and 46 of valve housing 22 and housing part 14 and between bores 40 and 44 of valve housing 22 and housing part 16. Passage 30 communicates with the outer end of piston bore 48 of housing part 14 at a port 50 (FIG. 8). Passage 32 communicates with an intermediate part of bore 48 of housing part 14 at a port 52. Passage 34 communicates with the outer end of piston bore 54 of housing part 16 at a port 56 (FIG. 8) and passage 36 communicates with an intermediate part of bore 54 of housing part 16 at a port 58. Manifold passages 42, 44 connect respectively to manifold ports 39, 41 which, in turn, are open at a lower or interior surface 43 of manifold 75 (FIG. 9). Manifold 75 has a park port 120 formed therein. A shuttle 122 and shuttle seat 124 are positioned within motor valve housing 22 between part port 120 and passages 46 (FIG. 9). A valve housing wall 128 separates passage 46 and park port 120 from valve housing bore 84. A passage 130 (FIGS. 4 and 9) is formed in valve housing wall 128 to place valve housing bore 84 in fluid communication with passage 46 or park port 120 as more fully explained below.

A dual piston unit 60 (FIG. 3) is contained within motor housing 10 and has a cushion 62 at each end. An annular groove is formed in each piston head 60 and receives a sealing ring 64. The intermediate portion 66 of piston unit 60 is narrow and has formed upon it a series of gear teeth 68 defining a rack. Gear teeth 68 mesh with a pinion gear 70 which is fixedly secured to motor shaft 26. Intermediate portion 66 of the piston unit has a planar surface 72. Valve housing 22 has a lower bearing surface 74. Bearing surface 74 slidably engages piston unit surface 72 to insure proper engagement of gear teeth 68 with pinion gear 70 as the piston unit 60 moves within the bores 48, 54. The bores 48, 54 preferably taper slightly toward their outermost ends.

Figure 7:
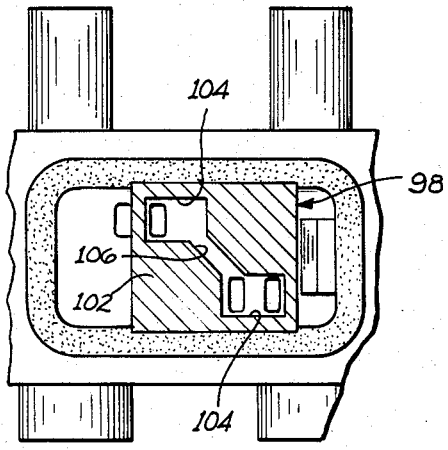
FIG. 7 is a partial sectional view taken along line 7—7 of FIG. 4.
Figure 10:
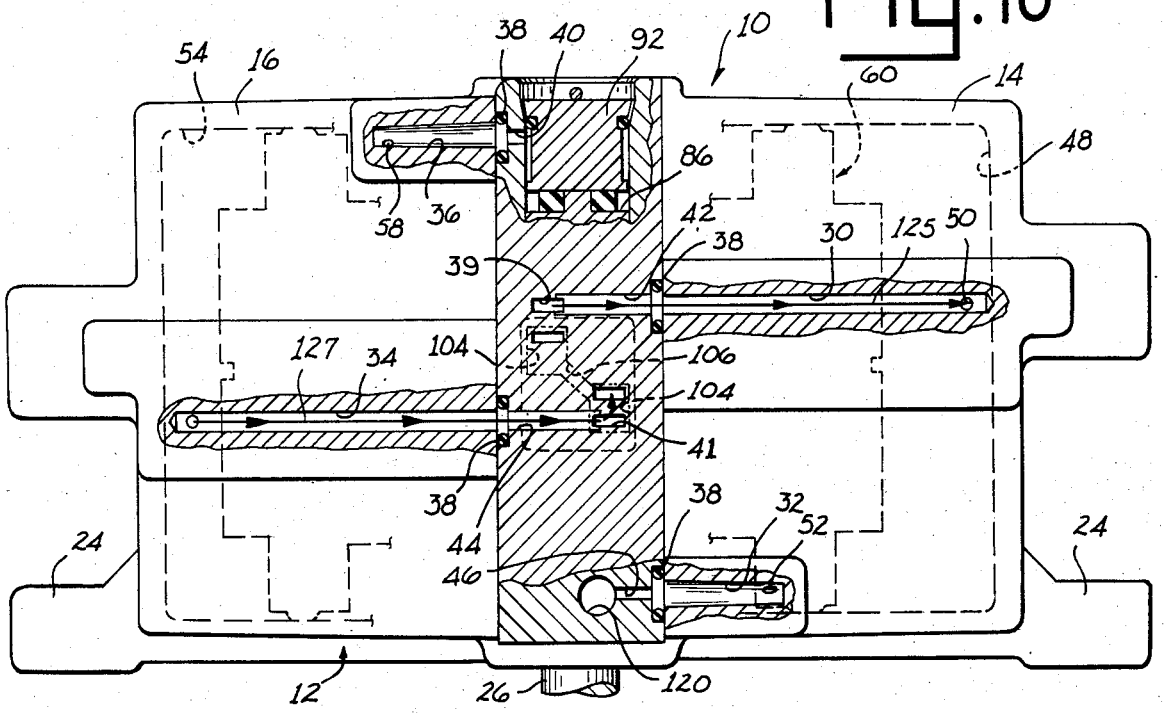
FIG. 10 is a sectional view taken on line 5—5 of FIG. 3 and shows the parts in the operational position of FIGS. 8 and 9.

Manifold 75 has a fluid inlet port 76 (FIG. 4) which communicates through an internal passage 78 with a port 80 and a cavity 82 formed in valve housing 22 (FIG. 9) in communication with bore 84. A spool valve 86 reciprocates within bore 84. Spool valve 86 has two spaced annular grooves 88 formed therein near its opposite ends which receive seal rings 90. One end of bore 84 has a stop 92 secured therein which limits motion of spool valve 86. Spool valve 86 includes a stepped recess 94. A coil spring 96 is seated within recess 94 and a valve slide 98 is also seated in the recess and is biased by spring 96 against the lower face 43 of manifold 75. Valve slide 98 (FIG. 7) fits within cavity 82 and reciprocates with spool valve 86. Valve slide 98 has an upper face 102 which includes offset recesses 104 (FIGS. 4 and 7) which are interconnected by a passage 106. As seen in FIGS. 5 and 10, valve slide recesses 104 and passage 106 alternately interconnect manifold passages 39, 41 with an exhaust port 108 (FIG. 8) in response to directed fluid flow in the operation of motor 10, as more fully described below. Valve slide 98 (FIG. 4) is preferably formed of a material such as Delrin 500 AF, for its wear and self lubricating qualities.

Exhaust port 108 communicates with valve housing cavity 82 (FIG. 4). An exhaust passage 110 interconnects port 108 to an exterior exhaust port 112. Exhaust port 112 has a restricted flow passage 114 formed therein (FIG. 8). A needle valve assembly 116 is so positioned in exhaust port 112 that by adjustment of the tension of a spring 118 bearing thereon, assembly 116 controls the pressure within motor 10 by controlling the pressure at which exhaust fluids exit the exhaust port.

Figure 3:
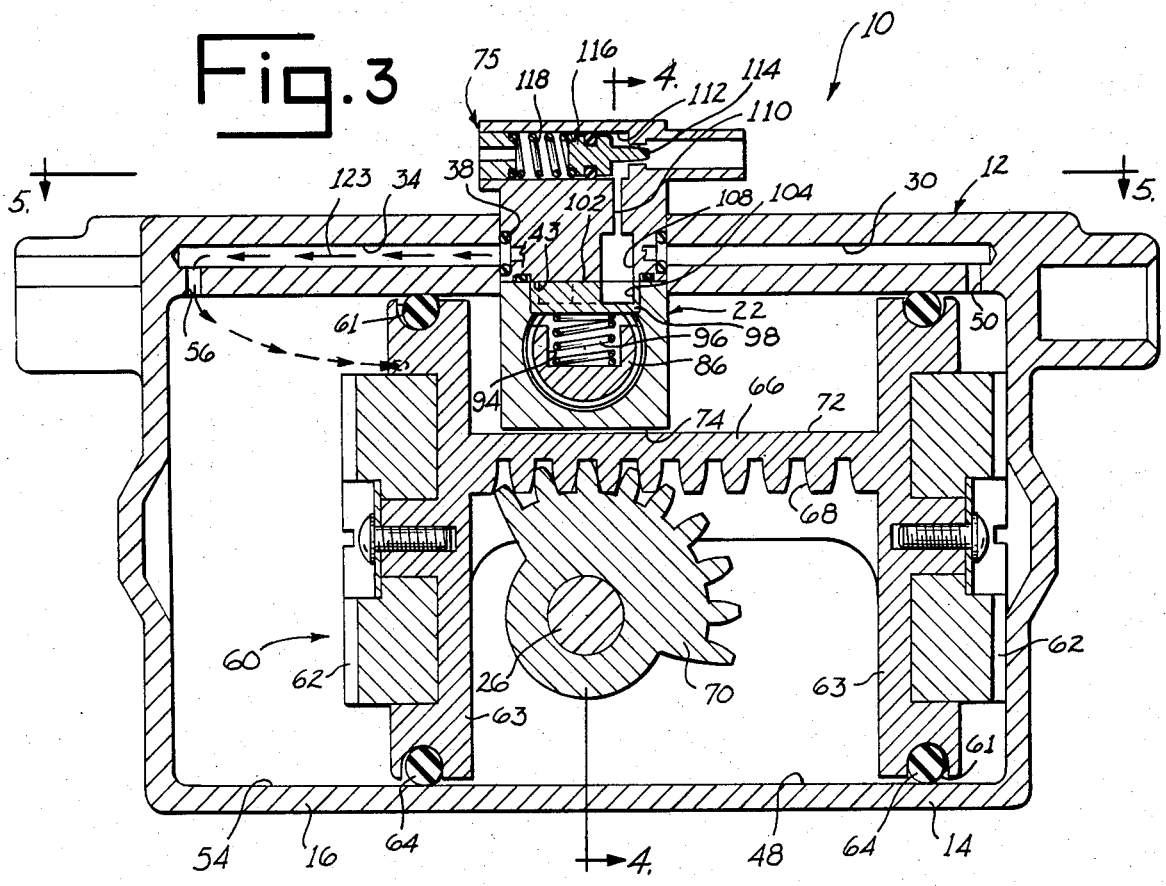
FIG. 3 is a sectional view of the motor taken along line 3—3 of FIG. 2.

Motor 10 will normally be in its inoperative or park position which is shown in FIGS. 3, 4, 5 and 6. In this position, spool valve 86 is seated against stop 92 and piston unit 60 is seated against the end wall of cylinder part 14 as shown in FIG. 3. When motor 10 is in its park position, pressurized air enters both manifold inlet port 76 and park port 120, as indicated by arrows 121 in FIG. 4. Pressurized air entering park port 120 forces shuttle 122 against its seat 124 and flows around the shuttle, through passage 130 and into valve housing bore 84. Air entering manifold inlet port 76 flows around valve slide 98, enters manifold port 41 and flows though bore 44 and passage 34 to port 56 and enters piston bore 54, as indicated by arrows 123 in FIGS. 3 and 5, forcing the piston unit 60 against the end wall of piston bore 48. When piston unit 60 is in its FIG. 3 position, seals 64 expose port 58 (FIG. 5) so that pressurized air from inlet port 76 enters port 58 and flows through passage 36, bore 40 and enters valve housing bore 84 at the end of spool valve 86, as illustrated in FIG. 5 by arrow 121. Pressurized air from park port 120 prevents shifting of spool valve 86.

Figure 12:
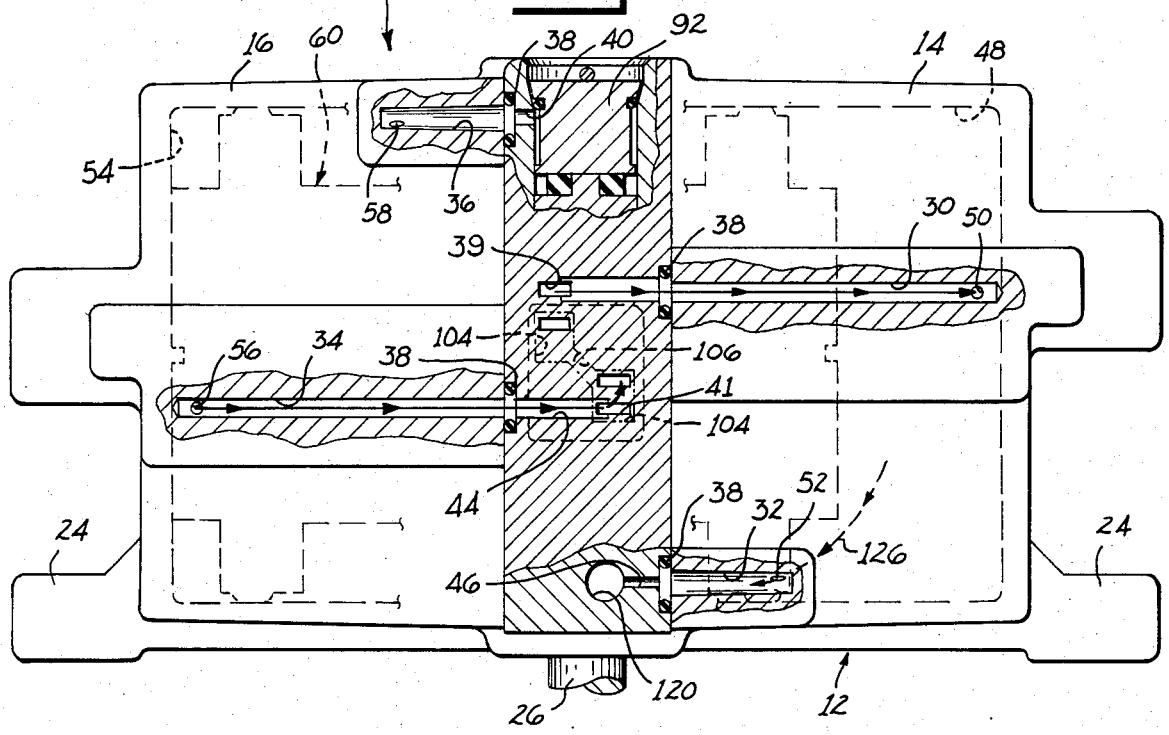
FIG. 12 is a part sectional view taken on line 5—5 of FIG. 3 showing the piston in its extreme position opposite that shown in FIG. 5 and immediately prior to a change of direction.
Figure 13:
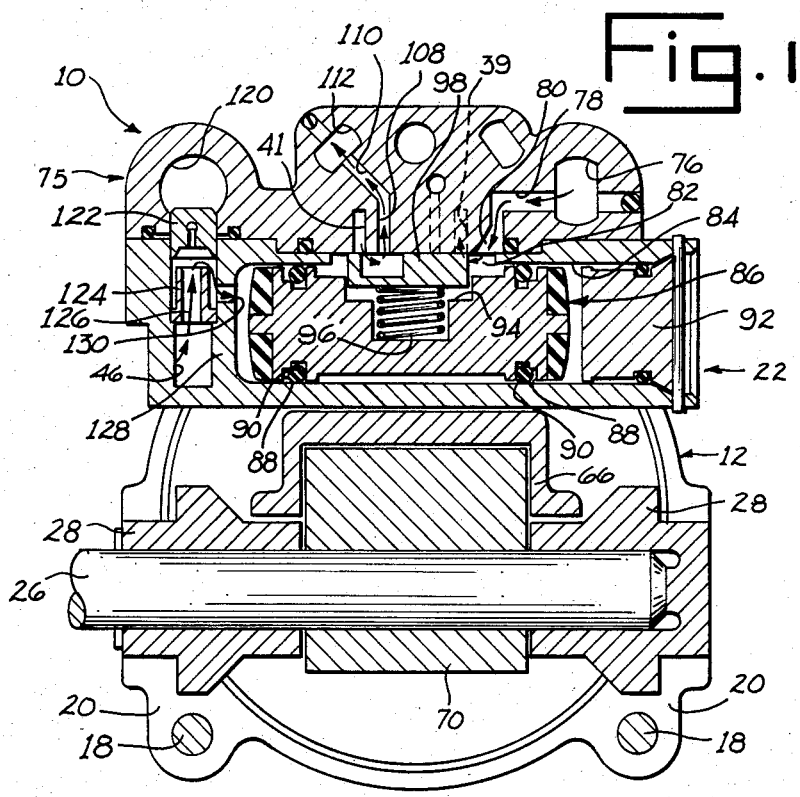
FIG. 13 is a sectional view taken on line 4—4 of FIG. 3 showing air flow paths and part positions for the operational position illustrated in FIG. 12.

When reciprocating operation of motor 10 is desired, a control valve (not shown) within a vehicle is shifted to the operating position, thus cutting off flow of pressurized air into park port 120. When the flow of pressurized air from park port 120 ceases, spool valve 86 shifts to the left, as oriented in FIG. 9, in response to pressurized air entering valve housing bore 84 from port 58, as described above. When spool valve 86 is in the position as oriented in FIG. 10, manifold ports 41 and 39 are connected by a recess 104 in the upper face 102 of valve slide 98. As a result, pressurized air from manifold inlet port 76 enters manifold port 39 and flows through manifold bore 42 and passage 30 where it enters piston bore 48 through port 50, as indicated by arrows 125 in FIGS. 8–10. This causes piston unit 60 to shift to the left, as oriented in FIG. 8. As piston unit 60 travels to the left, residual air in piston bore 54 is forced into passage 34 and bore 44 through port 56, as indicated by arrows 127 in FIGS. 8–10. Air exits bore 44 through manifold port 41 and enters manifold exhaust port 108 via valve slide recess 104, as indicated by arrows 127 in FIGS. 8 and 9. Air from exhaust port 108 enters exterior exhaust port 112 where pressure builds up until it overcomes the force of spring 118 and then exits manifold 75 via passage 14. Piston unit 60 continues its leftward travel until port 52 is exposed to pressurized air entering piston bore 48 from port 50. At this time, the pressurized air enters passage 32 and bore 46 whereupon shuttle 122 is unseated and air flows through shuttle seat 124, passage 128, and into valve housing bore 84, as shown by arrows 126 in FIGS. 12 and 13. This shifts spool valve 86 to the position as shown in FIG. 13. When valve 86 is so shifted, the right end of the valve is exhausted through residual air in chamber 84 being forced through passage 40, port 38 and passage 36 to exhaust air in chamber 54 and passage 34 (see arrows 127) to valve port 41 which is interconnected to valve section 104 and external exhaust. (See FIG. 10)

Figure 11:
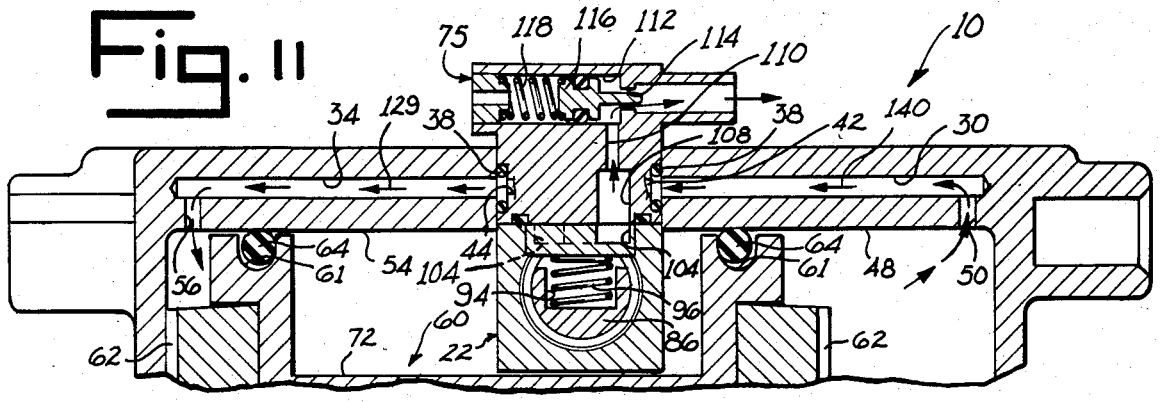
FIG. 11 is a partial sectional view taken on line 3—3 of FIG. 2 and shows the return of the parts to the position shown in FIGS. 3 and 4.
Figure 14:
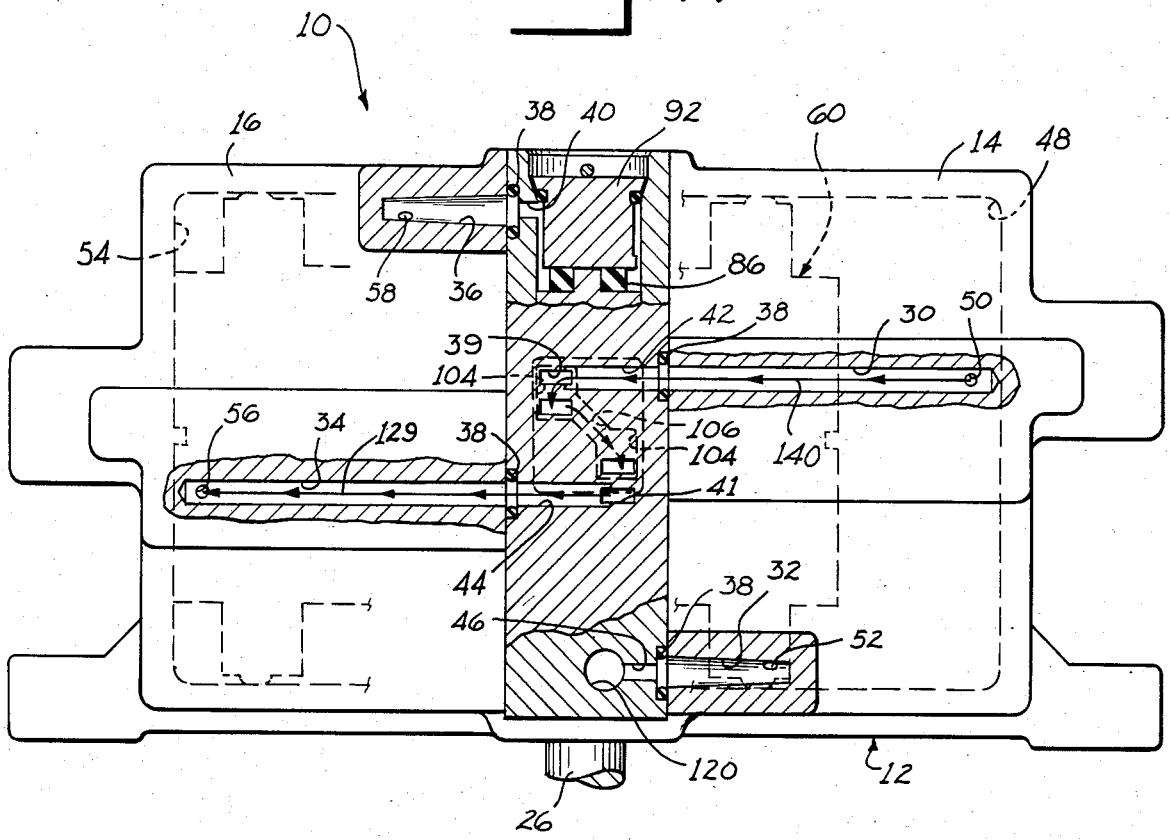
FIG. 14 is a part sectional view taken on line 5—5 of FIG. 3 showing air flow paths as the piston begins movement to the right.

When spool valve 86 is in its rightmost position, as shown in FIGS. 4 and 5, pressurized air from manifold inlet port 76 can no longer enter manifold port 39, but is forced to flow about valve slide 98 within valve housing cavity 82 until it enters manifold port 41, whereupon it flows through bore 44 and passage 34, as shown by arrows 129 in FIGS. 11 and 14. Air which exists passage 34 via port 56 causes piston unit 60 to move to the right, as oriented in FIG. 11. As piston unit 60 moves to the right, residual air in piston bore 48 enters port 50 and flows through passage 30 and bore 42, as indicated by arrows 140 of FIGS. 11 and 14. While spool valve 86 is in its rightmost position, as oriented in FIGS. 4 and 14, manifold ports 39 and 108 are connected by valve slide recesses 104 and passage 106 such that air exiting bore 42 via port 39 will enter port 108 and be exhausted from manifold 75 in the manner described above. As piston unit 60 continues its rightward travel, port 58 is exposed to pressurized air entering piston bore 54 from port 56. This air flows through passage 36 into port 40 whereupon it enters valve housing bore 84 causing spool valve 86 to shift to its leftmost position, as oriented in FIG. 9. This completes an operational cycle of motor 10.

The reciprocating shifting of piston unit 60 causes oscillation of shaft 26 as a result of the interengagement of rack teeth 68 and the pinion gear 70. When it is desired to halt operation of motor 10, the operator manipulates a control valve (not shown) which introduces pressurized air into park port 120 causing shuttle 122 to engage in sealing contact with its seat 124, as described above. This causes the components of motor 10 to come to rest in the position described above and illustrated in FIGS. 3, 4, 5 and 6. If it is desired that piston unit 60 come to rest in its park position at its most leftward position, valve housing 22 and manifold 75 may be mounted upon motor housing 12 in a position the reverse of that shown in FIGS. 4 and 9.

It is to be understood that the invention is not to be limited by the terms of the above description, but may be modified within the scope of the appended claims.

We claim:

1. An oscillatory fluid powered motor including a motor housing formed of two similar cup-shaped parts secured together at their open ends to form an elongated bore, a piston unit having spaced piston heads slidable in said bore, a motor shaft journaled in said housing, drive transmission means connecting said motor shaft and said piston unit for rotationally driving the motor shaft in response to linear motion of the piston unit, said housing parts having complementary passages therein, a valve unit having a housing secured to and transverse of said motor housing bore, said valve housing having a bore, a valve spool slidable in said valve housing bore, said valve housing having passages communicating with said motor housing passages, the improvement comprising a manifold mounted on said valve housing and having a flat face, said manifold having passages formed therein communicating with said motor housing passages, said manifold having a fluid inlet and a fluid outlet, a cavity formed in said valve housing for communication between said inlet and said valve housing bore, a valve slide mounted in and slidable with said valve spool and fitting within said cavity, said valve slide having a face in sliding contact with a face of said manifold, a face of said valve slide having a passage for selectively connecting said manifold and housing passages with said inlet and said outlet, said manifold passages being so arranged and communicating with said motor housing passages that said valve slide and said piston unit are caused to reciprocate in response to fluid pressure supplied at said inlet.

2. The motor of claim 1 wherein spring means are mounted between said valve slide and said valve spool for biasing said valve slide against said manifold face.

3. The motor of claim 1 wherein said fluid outlet includes valve means positioned therein for controlling the fluid pressure within said motor.

4. The motor of claim 1 and a manifold park fluid inlet, a park passage in fluid flow communication between said park inlet and said valve housing bore, whereby fluid introduced into said second inlet causes said valve spool to stop reciprocating.

5. The motor of claim 4 wherein one of said motor housing passages and a connected valve housing passage are in communication with said park passage, valve means positioned in said park passage for selectively permitting fluid flow into said valve housing bore in response to fluid pressure from said park inlet, whereby said valve spool stops its reciprocatory movement and said motor is stopped in its park position.

6. The motor of claim 5 wherein said valve housing and said passages therein are symmetrical about the longitudinal axis thereof, said manifold and said passages therein being symmetrical about the longitudinal axis thereof, whereby said valve housing and said manifold may be assembled to said motor housing in either of two opposite directions.

7. An oscillating fluid powered motor comprising a housing having a bore and a pair of passages opening at opposite ends of said bore, a dual piston slidable in said bore, a motor shaft journaled in said housing, drive transmission means connecting said piston and said shaft, a valve unit having a housing mounted on said motor housing and having a bore, said valve housing having a fluid inlet and outlet communicating with said valve housing bore, a valve spool slidable in said valve housing bore, and a manifold carried by said valve housing and cooperating with said valve spool to control fluid flow through said housing passages from said inlet to said outlet, said valve housing including a park passage communicating with one end of said valve housing bore, and a valve shiftable in said park passage to shift said valve spool to an inoperative position in response to fluid pressure supplied to said park passage.

* * * * *